US008960510B2

(12) United States Patent
Bertucci

(10) Patent No.: US 8,960,510 B2
(45) Date of Patent: Feb. 24, 2015

(54) WATCH BAND AND METHOD OF SECURING SAME

(71) Applicant: MH Bertucci, Inc., Gurnee, IL (US)

(72) Inventor: Michael H. Bertucci, Gurnee, IL (US)

(73) Assignee: MH Bertucci, Inc. IL (US)

( * ) Notice: Subject to any disclaimer, the term of this patent is extended or adjusted under 35 U.S.C. 154(b) by 118 days.

(21) Appl. No.: 13/834,517

(22) Filed: Mar. 15, 2013

(65) Prior Publication Data

US 2013/0313294 A1 Nov. 28, 2013

Related U.S. Application Data

(60) Provisional application No. 61/650,652, filed on May 23, 2012.

(51) Int. Cl.

| | |
|---|---|
| ***A44C 5/00*** | (2006.01) |
| ***A44C 5/20*** | (2006.01) |
| ***A44C 5/18*** | (2006.01) |

(52) U.S. Cl.

CPC ..... *A44C 5/18* (2013.01); *A44C 5/0053* (2013.01); *A44C 5/20* (2013.01)

USPC ..... 224/164; 224/178

(58) Field of Classification Search

USPC ..... 224/164–179; 24/265 B, 265 WS, 182

See application file for complete search history.

(56) References Cited

U.S. PATENT DOCUMENTS

| | | | | | |
|---|---|---|---|---|---|
| 970,184 | A * | 9/1910 | Conway | 24/309 |
| 1,165,262 | A * | 12/1915 | Jolly | 224/169 |
| 1,234,165 | A * | 7/1917 | Hill | 2/322 |
| 1,315,729 | A * | 9/1919 | Jolly | 224/176 |
| 1,420,604 | A * | 6/1922 | Allen, Jr. | 2/322 |
| 2,400,594 | A * | 5/1946 | Nienaber | 224/178 |
| D148,671 | S * | 2/1948 | Babin | D11/5 |
| 2,439,274 | A * | 4/1948 | Spector | 224/168 |
| 2,471,694 | A * | 5/1949 | Maestri | 24/574.1 |
| 2,751,132 | A * | 6/1956 | Myerson | 224/175 |
| 4,470,174 | A * | 9/1984 | Rhea | 24/68 E |
| 5,031,576 | A * | 7/1991 | Weinberg | 119/865 |
| 6,318,612 | B1 * | 11/2001 | MacNeil | 224/572 |
| 6,830,166 | B1 * | 12/2004 | Laats et al. | 224/164 |
| 7,275,667 | B2 * | 10/2007 | Bertucci | 224/178 |
| 7,832,605 | B2 * | 11/2010 | Bertucci | 224/164 |
| 2013/0313294 | A1 * | 11/2013 | Bertucci | 224/164 |

* cited by examiner

*Primary Examiner* — Justin Larson

(74) *Attorney, Agent, or Firm* — Clark Hill PLC

(57) ABSTRACT

A watch band is provided which provides a retention assembly for securing excess material of the watch band after the watch band has been secured. The watch band has first and second end portions. The first end portion has a plurality of aperture provided therethrough. The second end portion has a buckle, which has a prong, secured thereto at a free end thereof. The second end portion further has a keeper secured thereto distal from the free end thereof. The retention assembly has first and second portions which are configured to interlock with one another. The first portion of the retention assembly is associated with the second end portion proximate the keeper, and the second portion of the retention assembly is associated with the first end portion between the plurality of apertures and a free end of the first end portion.

31 Claims, 5 Drawing Sheets

WATCH BAND AND METHOD OF SECURING SAME

CROSS-REFERENCE AND INCORPORATION BY REFERENCE

This patent application claims the benefit of domestic priority of U.S. Provisional Application Ser. No. 61/650,652, filed May 23, and entitled "Watch Band and Method of Securing Same", U.S. Provisional Patent Application Ser. No. 61/650,652 is hereby incorporated by reference in its entirety.

FIELD OF THE INVENTION

The invention relates to watch bands. More particularly, the invention relates to watch bands having structure for securing excess material of a watch band and an associated method for securing this excess material.

BACKGROUND OF THE INVENTION

Watches are typically secured around a wearer's wrist by watch bands associated with the watches. The watch bands themselves typically come in standard lengths, but provide for means used to secure the watch band in place at a desired position depending on the size of the wearer's wrist. The means typically comprise a plurality of apertures provided along a length of the watch band and a watch buckle with a prong that is configured to extend through one of the plurality of apertures. Excess material on the watch band is typically held in place by a keeper.

With wearer's who have smaller wrists, however, the keeper may not adequately hold in all of the excess material such that the tip end portion of the watch band that extends beyond the keeper is not properly contained or retained. This extending part of the excess material of the watch band can cause problems for the wearer. For example, it can get caught on other items or uncomfortably rub against other parts of the wearer's body.

Thus, there is a need for a watch band which can contain or retain the excess material of the watch band. The present invention provides for such a watch band.

SUMMARY OF THE INVENTION

A preferred embodiment of the invention provides a watch band comprising a first end portion, a second end portion, and a retention assembly. The first end portion has top and bottom surfaces. The first end portion defines a free end thereof. The second end portion has top and bottom surfaces. The second end portion defines a free end thereof. The second end portion has a buckle secured thereto at the free end thereof. The retention assembly comprises a male portion and a female portion which are configured to interlock with one another. The male portion is provided by a portion of the top surface of one of the first and second end portions. The female portion is provided by a portion of the top surface of the other one of the first and second end portions.

A preferred embodiment of the invention provides a watch band comprising a first end portion and a second end portion. The first end portion has top and bottom surfaces. The first end portion defines a free end thereof. The first end portion has first and second raised portions on the top surface thereof. The first and second raised portions are separated from one another to define a gap therebetween. The second end portion has top and bottom surfaces. The second end portion defines a free end thereof. The second end portion is formed of first and second layers of material that are folded over upon one another to define the free end of the second end portion. The top surface of the second end portion is defined by the first layer of material. The bottom surface of the second end portion is defined by the second layer of material. The second end portion has a buckle secured thereto between the first and second layers of material at the free end thereof. The second end portion has a keeper secured thereto between the first and second layers of material distal from the free end thereof. The securement of the keeper to the second end portion provides a bump on the top surface of the second end portion. The bump of the first end portion is configured to interlock with the gap defined by the second end portion.

A preferred embodiment of the invention provides a watch band comprising a first end portion, a second end portion, and a retention assembly. The first end portion has top and bottom surfaces. The first end portion defines a free end thereof. The first end portion has a plurality of apertures provided therethrough. The second end portion has top and bottom surfaces. The second end portion defines a free end thereof. The second end portion has a buckle secured thereto at the free end thereof. The buckle has a prong. The second end portion has a keeper secured thereto distal from the free end thereof. The retention assembly comprises first and second portions which are configured to interlock with one another. The first portion of the retention assembly is associated with the second end portion proximate the keeper. The second portion of the retention assembly is associated with the first end portion between the plurality of apertures and the free end of the first end portion.

A preferred method of the invention provides a method of securing a watch band. The method includes the steps of providing a watch band, inserting a free end of a first end portion of the watch band into and through a buckle of the watch band until a desired position is achieved, inserting a prong of the buckle into and through one of the plurality of apertures provided through the first end portion, inserting the free end of the first end portion into and through a keeper of the watch band and thereby past a first portion of the retention assembly, thereby providing that an excess portion of the first end portion extends beyond the keeper, wherein the excess portion of the first end portion includes a second portion of the retention assembly, folding a portion of the excess portion of the first end portion over on itself, wherein the portion of the excess portion of the first end portion includes the second portion of the retention assembly, and interlocking the first portion of the retention assembly with the second portion of the retention assembly.

BRIEF DESCRIPTION OF THE DRAWINGS

The organization and manner of the structure and operation of the invention, together with further objects and advantages thereof, may best be understood by reference to the following description, taken in connection with the accompanying drawings, wherein like reference numerals identify like elements in which.

DETAILED DESCRIPTION OF THE ILLUSTRATED EMBODIMENTS

Figure 1:
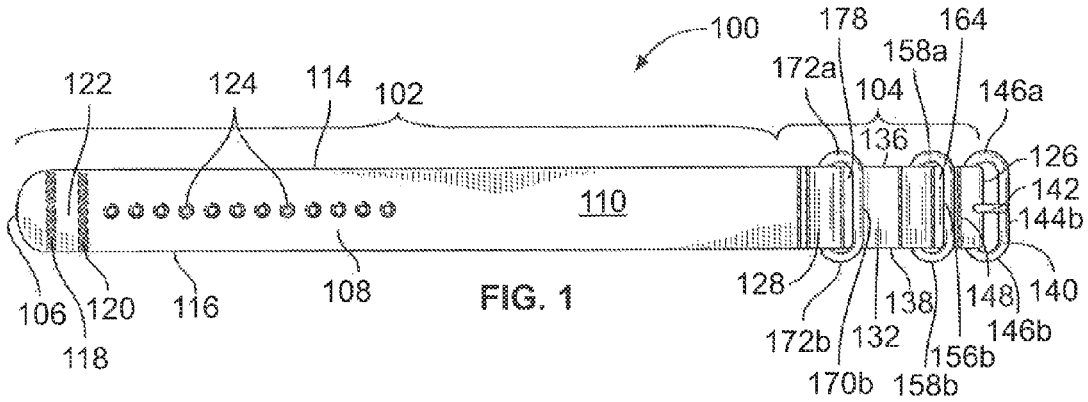
FIG. 1 is a top view of a first preferred embodiment of a watch band of the invention.

While the invention may be susceptible to embodiment in different forms, there is shown in the drawings, and herein will be described in detail, specific embodiments with the understanding that the present disclosure is to be considered an exemplification of the principles of the invention, and is not intended to limit the invention to that as illustrated and described herein.

The present invention provides for improvements in watch bands and the methods of securing same. A first embodiment of a watch band 100 of the present invention and a method of securing same is described in relation to FIGS. 1-7. A second embodiment of a watch band 200 of the present invention and a method of securing same is described in relation to FIGS. 8-14. Like elements are denoted with like reference numerals with the first embodiment being in the one hundreds and the second embodiment being in the two hundreds.

Figure 2:
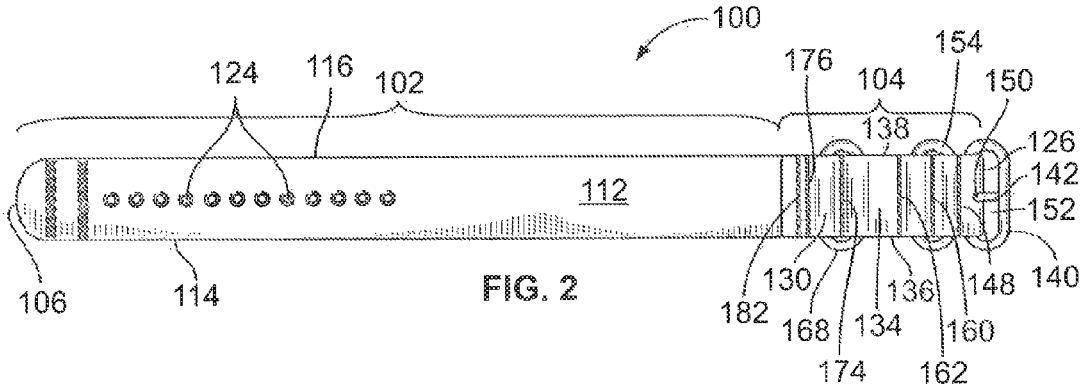
FIG. 2 is a bottom view of the first preferred embodiment of the watch band of the invention.
Figure 3:
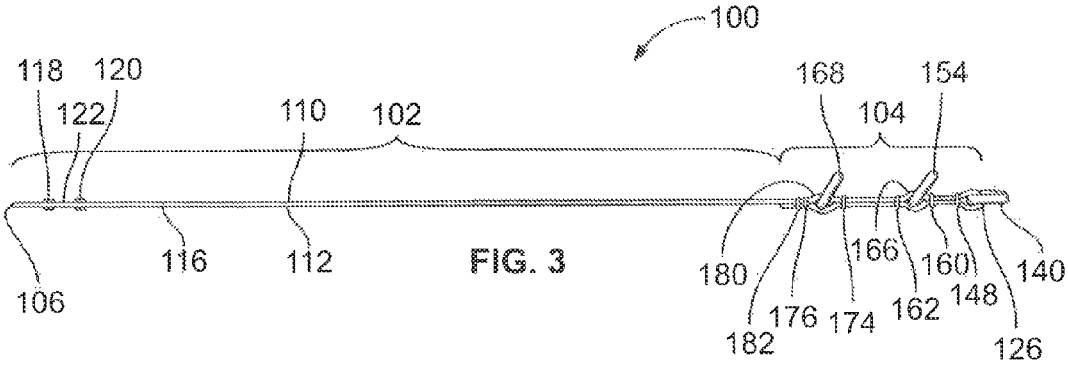
FIG. 3 is a side view of the first preferred embodiment of the watch band of the invention.

Attention is now directed to FIGS. 1-7 and the first embodiment of the watch band 100. The watch band 100 is preferably formed of a single piece of continuous material, preferably nylon. The watch band 100 has a first end portion 102 and a second end portion 104, as best illustrated in FIGS. 1-3.

The first end portion 102 extends from a first free end 106 of the watch band 100 to the second end portion 104. The first end portion 102 is formed of a single layer 108 of the single piece of continuous material and defines top and bottom surfaces 110, 112 and first and second side edges 114, 116.

The first end portion 102 preferably has a pair of portions 118, 120 which are raised off of the top surface 110 of the first end portion 102, as best illustrated in FIGS. 1 and 3. The raised portions 118, 120 are separated from one another and preferably extend from proximate the first side edge 114 to proximate the second side edge 116, but if desired, one or both of the raised portions 118, 120 could extend all the way to the side edges 114, 116. The raised portions 118, 120 are preferably formed by stitching, such that stitching may also be provided for on the bottom surface 112, as illustrated in FIG. 2. A gap 122 is thus defined between the raised portions 118, 120 and the top surface 110.

The first end portion 102 preferably is provided with a plurality of apertures 124 provided therethrough which are all preferably provided equidistant between the first and second side edges 114, 116 and which are all preferably provided equidistant to adjacent apertures 124. The apertures 124 are preferably positioned in a line which is transverse to the raised portions 118, 120. The raised portions 118, 120 are preferably positioned between the first free end 106 of the first end portion 102 and the apertures 124. The apertures 124 are preferably provided distal from the second end portion 104.

The second end portion 104 extends from a second free end 126 of the watch band 100 to the first end portion 102. The second end portion 104 is formed of a pair of layers 128, 130, both of which are provided by the single piece of continuous material. The single piece of continuous material is folded over on itself at the second free end 126 such that the layer 128 is the top layer and defines a top surface 132 of the second end portion 104, and such that the layer 130 is the bottom layer and defines a bottom surface 134 of the second end portion 104. The top layer 128 of the second end portion 104 connects to the single layer 108 of the first end portion 102 such that the top layer 128 is preferably generally planar with the single layer 108. The second end portion 102 defines first and second side edges 136, 138 with the first side edges 114, 136 preferably being generally planar with one another, and with the second side edges 116, 138 preferably being generally planar with one another.

The second end portion 104 has a buckle 140 having a prong 142 secured thereto. The buckle 140 is preferably generally oval or racetrack-shaped in configuration such that it has opposite straight portions 144*a* (not shown), 144*b* and opposite curved portions 146*a*, 146*b*. The prong 142 is preferably secured to the straight portion 144*a* and extends toward the straight portion 144*b*. The straight portion 144*a* of the buckle 140 is positioned between the top and bottom layers 128, 130 and is secured in place between the second free end 126 (which is defined by the fold between the top and bottom layers 128, 130) and a first stitching 148 which secures the top and bottom layers 128, 130 together. The first stitching 148 preferably extends from the first side edge 136 to the second side edge 138. The prong 142 extends through an aperture 150 formed through the piece of material at the second free end or fold 126. An opening 152 of the buckle 140 is thus defined between the second free end or fold 126 and the straight and curved portions 144*b*, 146*a*, 146*b* of the buckle 140.

The second end portion 104 preferably has a first keeper 154 secured thereto. The keeper 154 is preferably generally oval or racetrack-shaped in configuration such it has opposite straight portions 156*a* (not shown), 156*b* and opposite curved portions 158*a*, 158*b*. The straight portion 156*a* of the keeper 154 is positioned between the top and bottom layers 128, 130 and is secured in place between a second stitching 160 which secures the top and bottom layers 128, 130 together and a third stitching 162 which secures the top and bottom layers 128, 130 together. Both the second and third stitchings 160, 162 preferably extend from the first side edge 136 to the second side edge 138. The first keeper 154 encircles the top layer 128 and defines an opening 164 between the top surface 132 of the top layer 128 and the straight and curved portions 156*b*, 158*a*, 158*b* of the first keeper 154. Due to the securement of the first keeper 154 in this manner, the top surface 132 of the top layer 128 is raised where the first keeper 154 is provided relative to where the second and third stitchings 160, 162 are provided, thereby defining a first bump 166 of the top surface 132 of the top layer 128, as illustrated in FIG. 2.

The second end portion 104 preferably has a second keeper 168 secured thereto. The keeper 168 is preferably generally oval or racetrack-shaped in configuration such it has opposite straight portions 170*a* (not shown), 170*b* and opposite curved portions 172*a*, 172*b*. The straight portion 170*a* of the keeper 168 is positioned between the top and bottom layers 128, 130 and is secured in place between a fourth stitching 174 which secures the top and bottom layers 128, 130 together and a fifth stitching 176 which secures the top and bottom layers 128, 130 together. Both the fourth and fifth stitchings 174, 176 preferably extend from the first side edge 136 to the second side edge 138. The second keeper 168 encircles the top layer 128 and defines an opening 178 between the top surface 132 of the top layer 128 and the straight and curved portions 170*b*, 172*a*, 172*b* of the second keeper 168. Due to the securement of the second keeper 168 in this manner, the top surface 132 of the top layer 128 is raised where the second keeper 168 is provided relative to where the fourth and fifth stitchings 174, 176 are provided, thereby defining a second bump 180 of the top surface 132 of the top layer 128, as illustrated in FIG. 3.

A sixth stitching 182 is provided proximate to the first end portion 102 which secures the top and bottom layers 128, 130 together. It is to be understood, and as best illustrated in FIG. 3, that the first stitching 148 is provided most proximate to the second free end 126, but most distal from the first end portion 102, and that the sixth stitching 182 is provided most distal from the second free end 126, but most proximate to the first end portion 102, with the other stitchings 160, 162, 174, 176 being positioned therebetween.

Securement of the watch band 100 will now be discussed with reference to FIGS. 4-6. As is typical, the watch band 100 is placed around a user's wrist, typically with a portion of the first end portion 102 (which is provided between the apertures 124 and the second end portion 104) being positioned against a top of the user's wrist (as the watch casing (not shown) typically will be provided on this portion of the first end portion 102). The user than pulls the first end portion 102 of the watch band 100 around and under the user's wrist and then back up toward the second end portion 104.

Figure 4:
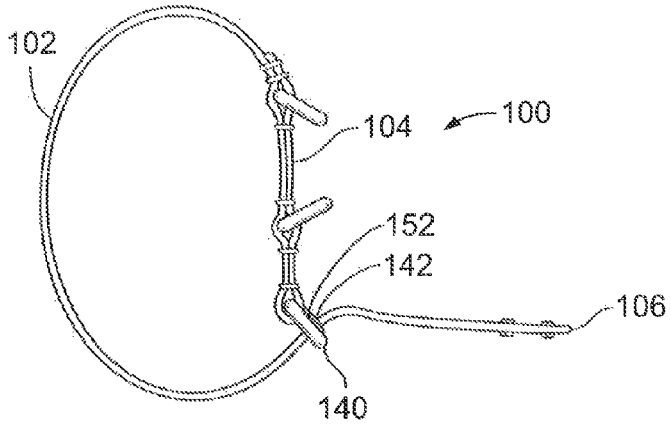
FIGS. 4-6 are side views illustrating the securement of the first preferred embodiment of the watch band of the invention.

As illustrated in FIG. 4, the first free end 106 of the first end portion 102 is then inserted into and through the opening 152 defined by the buckle 140. The first end portion 102 continues to be pulled into and through the opening 152 defined by the buckle 140 until the desired fit of the watch band 100 around the user's wrist is achieved. The prong 142 of the buckle 140 is then inserted through the appropriate aperture 124 provided through the first end portion 102 in order to secure the watch band 100 around the user's wrist.

Figure 5:
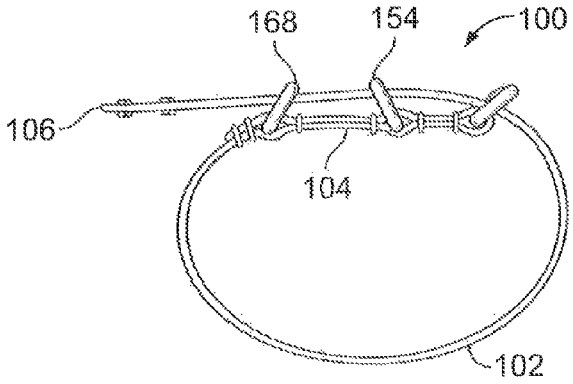

As illustrated in FIG. 5, the first free end 106 of the first end portion 102 is then further inserted into and through the keeper 154 and then into and through the keeper 168. For users with larger wrists, this is essentially the end of the process for securing the watch band 100 as the keepers 154, 168 will retain the excess portion of the first end portion 102 provided beyond the buckle 140 in place. However, users with smaller wrists are the users that will most benefit from the unique construction of the watch band 100 and the method of securing same.

For users with smaller wrists, when the first free end 106 of the first end portion 102 is inserted into and through the keeper 168, a portion of the first end portion 102 will still extend beyond the keeper 168 (as illustrated in FIG. 5) and will essentially provide excess material which can protrude from the user's wrist and, as explained hereinabove in the "Background of the Invention" section, such excess material is undesirable. The present invention provides for an interlocking retention assembly 184 and a method to secure this excess material.

Figure 6:
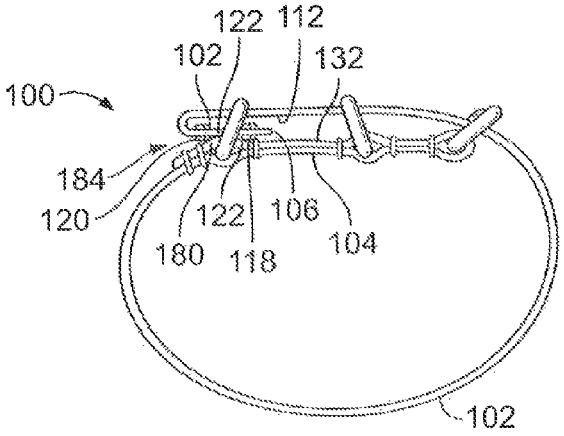

More specifically, the user then folds the excess material of the first end portion 102 under itself and then inserts the folded-over first end portion 102 between the top surface 132 of the second end portion 104 and the bottom surface 112 of the first end portion 102 until the second bump 180 is positioned within the gap 122 provided between the raised portions 118, 120 provided on the top surface 110 of the folded-over first end portion 102, as best illustrated in FIG. 6. Thus, the second bump 180 of the second end portion 104 and the gap 122 defined by the raised portions 118, 120 of the first end portion 102 form an interlocking retention assembly 184 of the watch band 100. The interlocking retention assembly 184 provides a "male" portion thereof, which is the second bump 180 of the second end portion 104, and a "female" portion thereof, which is the gap 122 defined by the raised portions 118, 120 of the first end portion 102. When the "male" and "female" portions are interlocked, the "male" portion is retained within the "female" portion by the raised portions 118, 120, which provide resistance to the "male" portion being moved out of the "female" portion. Thus, the interlocking retention assembly 184 prevents the folded-over first end portion 102 from moving out of this position absent a force being applied to the first end portion 102 which causes the resistance to be overcome. With the "male" and "female" portions of the interlocking retention assembly being interlocked with one another, the excess material of the watch band 100 is secured in place such that the watch band 100 is not uncomfortable for the user to wear.

Figure 7:
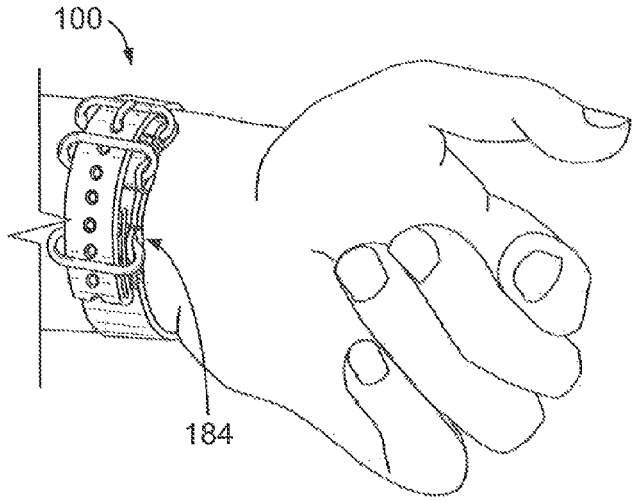
FIG. 7 is a perspective view illustrating the first preferred embodiment of the watch band of the invention secured around a user's wrist.

FIG. 7 illustrates the watch band 100 in securement around a user's wrist with the interlocking retention assembly 184 being used.

Attention is now directed to FIGS. 8-14 and the second embodiment of the watch band 200. The watch band 200 is preferably formed of two separate pieces of material, preferably nylon. The watch band 200 has a first end portion 202 (defined by one of the two pieces of material) and a second end portion 204 (defined by the other one of the two pieces of material).

The first end portion 202 extends from a first free end 206 of the watch band 200 to an opposite end 207 which is secured to a first bar (typically a spring bar) of a watch casing 211 in a known manner. The first end portion 202 is formed of a single layer 208 of the piece of material and defines top and bottom surfaces 210, 212 and first and second side edges 214, 216.

Figure 8:
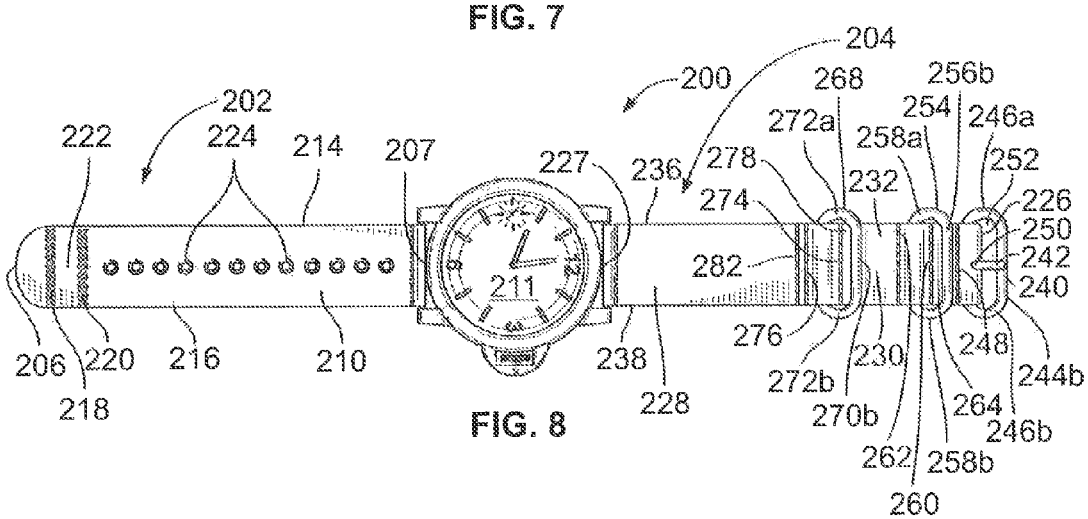
FIG. 8 is a top view of a second preferred embodiment of a watch band of the invention where the watch band is formed in two parts, with each part being secured to a bar of a watch casing.
Figure 9:
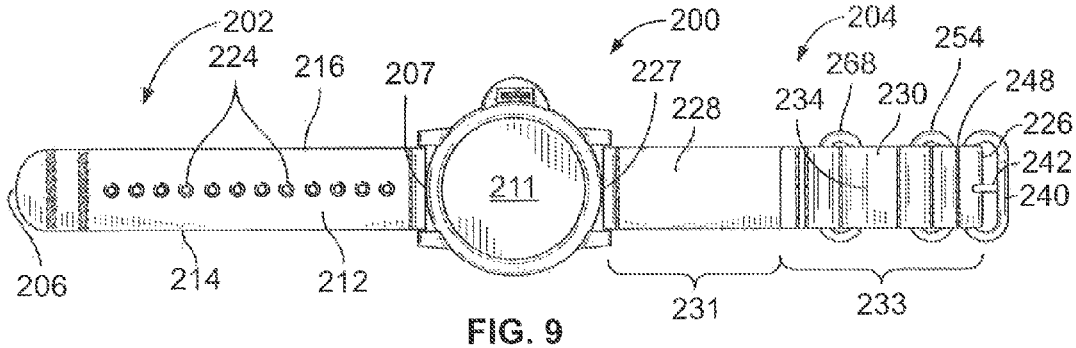
FIG. 9 is a bottom view of the second preferred embodiment of the watch band of the invention.
Figure 10:
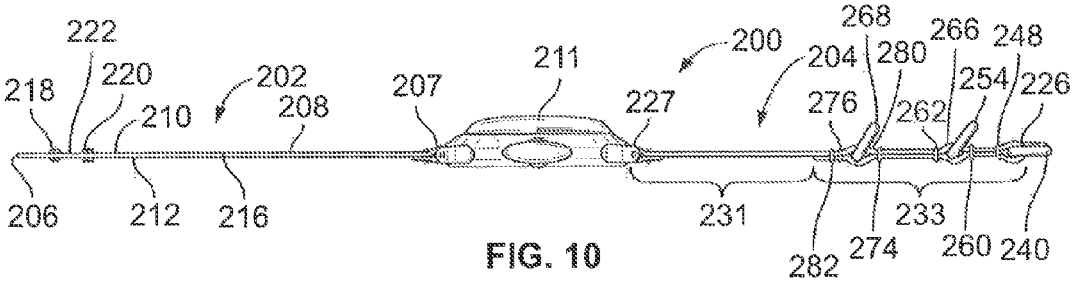
FIG. 10 is a side view of the second preferred embodiment of the watch band of the invention.

The first end portion 202 preferably has a pair of portions 218, 220 which are raised off of the top surface 210 of the first end portion 202, as best illustrated in FIGS. 8 and 10. The raised portions 218, 220 are separated from one another and preferably extend from proximate the first side edge 214 to proximate the second side edge 216, but if desired, one or both of the raised portions 218, 220 could extend all the way to the side edges 214, 216. The raised portions 218, 220 are preferably formed by stitching such that stitching may also be provided for on the bottom surface 212, as illustrated in FIG. 9. A gap 222 is thus defined between the raised portions 218, 220 and the top surface 210.

The first end portion 202 preferably is provided with a plurality of apertures 224 provided therethrough which are all preferably provided equidistant between the first and second side edges 214, 216 and which are all preferably provided equidistant to adjacent apertures 224. The apertures 224 are preferably positioned in a line which is transverse to the raised portions 218, 220. The raised portions 218, 120 are preferably positioned between the first free end 206 of the first end portion 202 and the apertures 224. The apertures 224 are preferably provided distal from the second end 207.

The second end portion 204 extends from a second free end 226 of the watch band 200 to an opposite end 227 which is secured to a second bar (typically a spring bar) of a watch casing 211 in a known manner. The second end portion 202 is formed of inner and outer portions 231, 233. The inner portion 231 is formed of a single layer 228 of the piece of material and the outer portion 233 is formed of a pair of layers 228, 230, both of which are provided by the piece of material. The layers 228 of the inner and outer portions 231, 233 are preferably planar and contiguous with one another. The second end portion 204 defines first and second side edges 236, 238. The second free end 226 of the second end portion 204 is provided by the outer portion 233 while the opposite end 227 of the second end portion 204 is provided by the inner portion 231.

The piece of material is folded over on itself at the second free end 226 to form the outer portion 233 such that the layer 228 is the top layer and defines a top surface 232 of the outer portion 233 of the second end portion 204, and such that the layer 230 is the bottom layer and defines a bottom surface 234 of the outer portion 233 of the second end portion 204.

The outer portion 233 of the second end portion 204 has a buckle 240 having a prong 242 secured thereto. The buckle 240 is preferably generally oval or racetrack-shaped in configuration such that it has opposite straight portions 244*a* (not shown), 244*b* and opposite curved portions 246*a*, 246*b*. The prong 242 is preferably secured to the straight portion 244*a* and extends toward the straight portion 244*b*. The straight portion 244*a* of the buckle 240 is positioned between the top and bottom layers 228, 230 and is secured in place between the second free end 226 (which is defined by the fold between the top and bottom layers 228, 230) and a first stitching 248 which secures the top and bottom layers 228, 230 together. The first stitching 248 preferably extends from the first side edge 236 to the second side edge 238. The prong 242 extends through an aperture 250 formed through the piece of material at the second free end or fold 226, An opening 252 of the buckle 240 is thus defined between the second free end or fold 226 and the straight and curved portions 244*b*, 246*a*, 246*b* of the buckle 240.

The outer portion 233 of the second end portion 204 preferably has a first keeper 254 secured thereto. The keeper 254 is preferably generally oval or racetrack-shaped in configuration such it has opposite straight portions 256*a* (not shown), 256*b* and opposite curved portions 258*a*, 258*b*. The straight portion 256*a* of the keeper 254 is positioned between the top and bottom layers 228, 230 and is secured in place between a second stitching 260 which secures the top and bottom layers 228, 230 together and a third stitching 262 which secures the top and bottom layers 228, 230 together. Both the second and third stitchings 260, 262 preferably extend from the first side edge 236 to the second side edge 238. The first keeper 254 encircles the top layer 228 and defines an opening 264 between the top surface 232 of the top layer 228 and the straight and curved portions 256*b*, 258*a*, 258*b* of the first keeper 254. Due to the securement of the first keeper 254 in this manner, the top surface 232 of the top layer 228 is raised where the first keeper 254 is provided relative to where the second and third stitchings 260, 262 are provided, thereby defining a first bump 266 of the top surface 232 of the top layer 228, as best illustrated in FIG. 10.

The outer portion 233 of the second end portion 204 preferably has a second keeper 268 secured thereto. The keeper 268 is preferably generally oval or racetrack-shaped in configuration such it has opposite straight portions 270*a* (not shown), 270*b* and opposite curved portions 272*a*, 272*b*. The straight portion 270*a* of the keeper 268 is positioned between the top and bottom layers 228, 230 and is secured in place between a fourth stitching 274 which secures the top and bottom layers 228, 230 together and a fifth stitching 276 which secures the top and bottom layers 228, 230 together. Both the fourth and fifth stitchings 274, 276 preferably extend from the first side edge 236 to the second side edge 238. The second keeper 268 encircles the top layer 228 and defines an opening 278 between the top surface 232 of the top layer 228 and the straight and curved portions 270*b*, 272*a*, 272*b* of the second keeper 268. Due to the securement of the second keeper 268 in this manner, the top surface 232 of the top layer 228 is raised where the second keeper 268 is provided relative to where the fourth and fifth stitchings 274, 276 are provided, thereby defining a second bump 280 of the top surface 232 of the top layer 228, as illustrated in FIG. 10.

A sixth stitching 282 is provided on the outer portion 233 proximate to the inner portion 231 of the second end portion 204. The sixth stitching 282 secures the top and bottom layers 228, 230 together. It is to be understood, and as best illustrated in FIG. 10, that the first stitching 248 is provided most proximate to the second free end 226, but most distal from the inner portion 231, and that the sixth stitching 282 is provided most distal from the second free end 226, but most proximate to the inner portion 231, with the other stitchings 260, 262, 274, 276 being positioned therebetween.

Securement of the watch band 200 will now be discussed with reference to FIGS. 11-13. As is typical, the watch band 200 is placed around a user's wrist, typically with the watch casing 211 positioned against a top of the user's wrist. The user than pulls the first end portion 202 of the watch band 200 around and under the user's wrist and then back up toward the second end portion 204.

Figure 11:
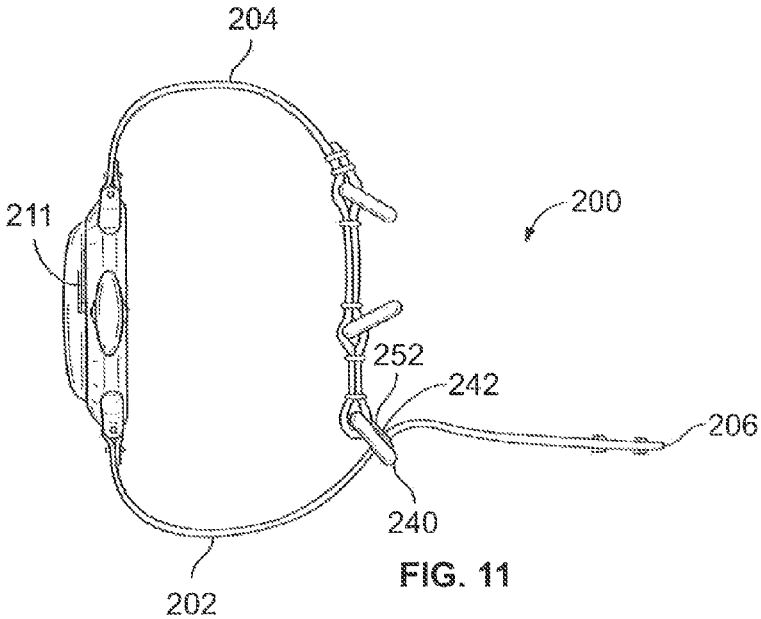
FIGS. 11-13 are side views illustrating the securement of the second preferred embodiment of the watch band of the invention.

As illustrated in FIG. 11, the first free end 206 of the first end portion 202 is then inserted into and through the opening 252 defined by the buckle 240. The first end portion 202 continues to be pulled into and through the opening 252 defined by the buckle 240 until the desired fit of the watch band 200 around the user's wrist is achieved. The prong 242 of the buckle 240 is then inserted through the appropriate aperture 224 provided through the first end portion 202 in order to secure the watch band 200 around the user's wrist.

Figure 12:
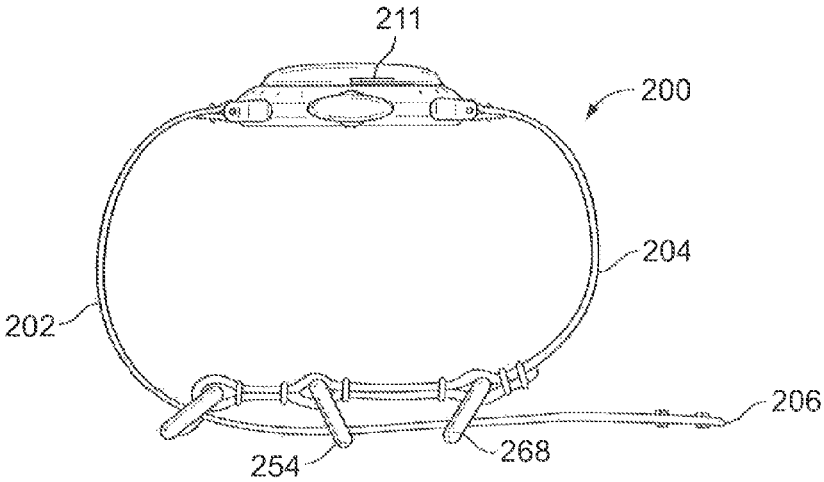

As illustrated in FIG. 12, the first free end 206 of the first end portion 202 is then further inserted into and through the keeper 254 and then into and through the keeper 268. For users with larger wrists, this is essentially the end of the process for securing the watch band 200 as the keepers 254, 268 will retain the excess portion of the first end portion 202 provided beyond the buckle 240 in place. However, users with smaller wrists are the users that will most benefit from the unique construction of the watch band 200 and the method of securing same.

For users with smaller wrists, when the first free end 206 of the first end portion 202 is inserted into and through the keeper 268, a portion of the first end portion 202 will still extend beyond the keeper 268 (as illustrated in FIG. 12) and will essentially provide excess material which can protrude from the user's wrist and, as explained hereinabove in the "Background of the Invention" section, such excess material is undesirable. The present invention provides for an interlocking retention assembly 284 and a method to secure this excess material.

Figure 13:
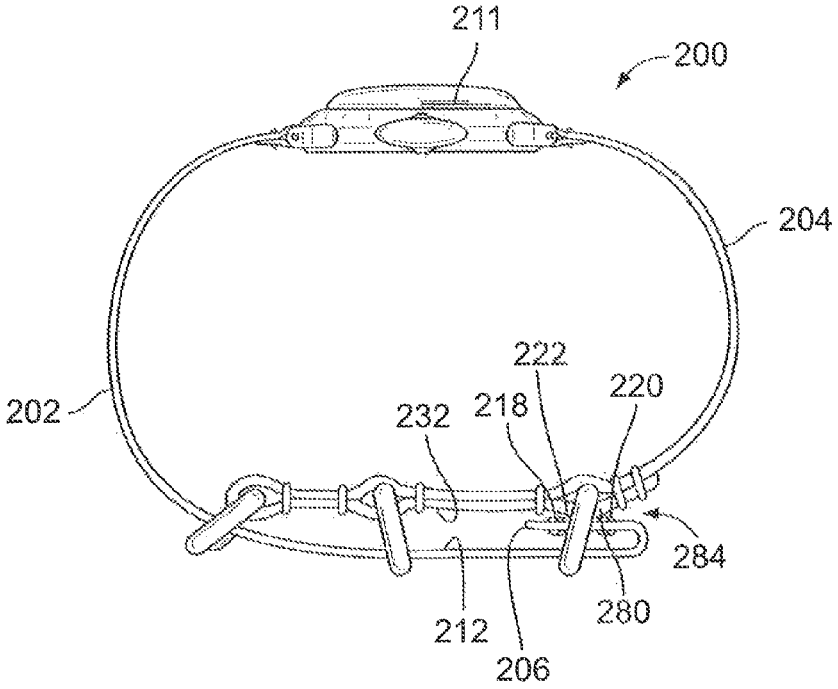

More specifically, the user then folds the excess material of the first end portion 202 under itself and then inserts the folded-over first end portion 202 between the top surface 232 of the outer portion 233 of the second end portion 204 and the bottom surface 212 of the first end portion 202 until the second bump 280 is positioned within the gap 222 provided between the raised portions 218, 220 provided on the top surface 210 of the folded-over first end portion 202, as best illustrated in FIG. 13. Thus, the second bump 280 of the outer portion 233 of the second end portion 204 and the gap 222 defined by the raised portions 218, 220 of the first end portion 202 form an interlocking retention assembly 284 of the watch band 200. The interlocking retention assembly 284 provides a "male" portion thereof, which is the second bump 280 of the outer portion 233 of the second end portion 204, and a "female" portion thereof, which is the gap 222 defined by the raised portions 218, 220 of the first end portion 202. When the "male" and "female" portions are interlocked, the "male" portion is retained within the "female" portion by the raised portions 218, 220, which provide resistance to the "male" portion being moved out of the "female" portion. Thus, the interlocking retention assembly 284 prevents the folded-over first end portion 202 from moving out of this position absent a force being applied to the first end portion 202 which causes the resistance to be overcome, With the "male" and "female" portions of the interlocking retention assembly being interlocked with one another, the excess material of the watch band 200 is secured in place such that the watch band 200 is not uncomfortable for the user to wear.

Figure 14:
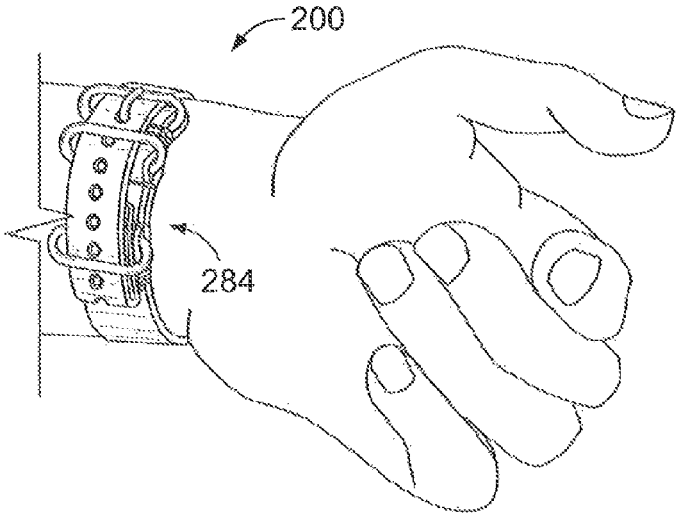
FIG. 14 is a perspective view illustrating the second embodiment of the watch band of the invention secured around a user's wrist.

FIG. 14 illustrates the watch band 200 in securement around a user's wrist with the interlocking retention assembly 284 being used.

While preferred embodiments of the present invention are shown and described, it is envisioned that those skilled in the art may devise various modifications of the present invention without departing from the spirit and scope of the invention. Such modifications may include, but are not limited to, the following examples: the keepers 154, 254 could be removed from the watch bands 100, 200, such that the second and third stitchings 160, 162; 260, 262 could also be removed from the watch bands 100, 200; the top and bottom layers 128, 130; 228, 230 of the second end portions 104, 204 (the outer portion 233 of the second end portion 204) could be secured together in a manner other than by stitching; the raised portions 118, 120; 218, 220 of the first end portions 102, 202 could be formed in a manner other than by stitching; and the first end portions 102, 202 could be folded in the opposite direction and be retained in place by the straight portions 170*b*, 270*b* of the keepers 168, 268 (or bumps formed thereon) which is configured to interlock with raised portions formed on the bottom surfaces 112, 212 of the first end portions 102, 202 (for example the stitchings illustrated in FIGS. 2 and 9)—although it is noted that this is not a preferred embodiment because it does not provide as "clean" of a look.

The invention is claimed as follows:

1. A watch band comprising:

a first end portion having top and bottom surfaces, the first end portion defining a free end thereof;

a second end portion having top and bottom surfaces, the second end portion defining a free end thereof, the second end portion having a buckle secured thereto at the free end thereof; and a retention assembly comprising a male portion and a female portion which are configured to interlock with one another, the male portion being provided by a portion of the top surface of one of the first and second end portions, the female portion being provided by a portion of the top surface of the other one of the first and second end portions.

2. The watch band as defined in claim 1, wherein the male portion is provided by a portion of the top surface of the second end portion, and wherein the female portion is provided by a portion of the top surface of the first end portion.

3. The watch band as defined in claim 2, wherein the second end portion has a keeper secured thereto distal from the free end thereof, wherein the securement of the keeper to the second end portion provides a bump on the top surface of the second end portion, wherein the bump defines the male portion of the retention assembly.

4. The watch band as defined in claim 3, wherein the first end portion has first and second raised portions on the top surface thereof, the first and second raised portions being separated from one another to define a gap therebetween, wherein the gap defines the female portion of the retention assembly.

5. The watch band as defined in claim 2, wherein the first end portion has first and second raised portions on the top surface thereof, the first and second raised portions being separated from one another to define a gap therebetween, wherein the gap defines the female portion of the retention assembly.

6. The watch band as defined in claim 1, wherein the first and second end portions are connected to one another, thereby defining that the free ends of the first and second end portions are opposite ends of the watch band.

7. The watch band as defined in claim 1, wherein the first end portion has an end opposite the free end thereof which is configured to be secured to a first bar of a watch casing, and wherein the second end portion has an end opposite the free end thereof which is configured to be secured to a second bar of the watch casing.

8. A watch band comprising:

a first end portion having top and bottom surfaces, the first end portion defining a free end thereof, wherein the first end portion has first and second raised portions on the top surface thereof, the first and second raised portions being separated from one another to define a gap therebetween; and a second end portion having top and bottom surfaces, the second end portion defining a free end thereof, the second end portion being formed of first and second layers of material that are folded over upon one another to define the free end of the second end portion, the top surface of the second end portion being defined by the first layer of material, the bottom surface of the second end portion being defined by the second layer of material, the second end portion having a buckle secured thereto between the first and second layers of material at the free end thereof, the second end portion having a keeper secured thereto between the first and second layers of material distal from the free end thereof, wherein the securement of the keeper to the second end portion provides a bump on the top surface of the second end portion, wherein the bump of the first end portion is configured to interlock with the gap defined by the second end portion.

9. The watch band as defined in claim 8, wherein the first and second end portions are connected to one another, thereby defining that the free ends of the first and second end portions are opposite ends of the watch band.

10. The watch band as defined in claim 8, wherein the first end portion has an end opposite the free end thereof which is configured to be secured to a first bar of a watch casing, and wherein the second end portion has an end opposite the free end thereof which is configured to he secured to a second bar of the watch casing.

11. The watch band as defined in claim 8, wherein an aperture is provided through the free end of the second end portion, and wherein the buckle is provided with a prong which extends through the aperture in the free end of the second end portion.

12. The watch band as defined in claim 11, wherein the first end portion has a plurality of apertures provided therethrough, wherein the prong of the buckle is configured to extend through any one of the plurality of apertures in order to secure the first end portion to the second end portion.

13. The watch band as defined in claim 12, wherein the first end portion has first and second side edges, and wherein the plurality of apertures are provided generally equidistantly between the first and second side edges of the first end portion.

14. The watch band as defined in claim 12, wherein the first and second raised portions are positioned between the free end of the first end portion and the plurality of apertures.

15. The watch band as defined in claim 8, wherein the first end portion has first and second side edges, and wherein the first and second raised portions generally extend from proximate the first side edge to proximate the second side edge.

16. The watch band as defined in claim 8, wherein the first and second raised portions are generally parallel to one another.

17. The watch band as defined in claim 8, wherein the first and second raised portions are formed by stitching.

18. A watch band comprising:

a first end portion having top and bottom surfaces, the first end portion defining a free end thereof, the first end portion having a plurality of apertures provided therethrough;

a second end portion having top and bottom surfaces, the second end portion defining a free end thereof, the second end portion having a buckle secured thereto at the free end thereof, the buckle having a prong, the second end portion having a keeper secured in place thereto distal from the free end thereof; and a retention assembly comprising first and second portions which are configured to interlock with one another, the first portion of the retention assembly being associated with the second end portion proximate the keeper, the second portion of the retention assembly being associated with the first end portion between the plurality of apertures and the free end of the first end portion.

19. The watch band as defined in claim 18, wherein the first portion of the retention assembly is a male portion which is associated with the second end portion, and wherein the second portion of the retention assembly is a female portion that is associated with the first end portion.

20. The watch band as defined in claim 19, wherein the male portion is provided by a portion of the top surface of the second end portion, and wherein the female portion is provided by a portion of the top surface of the first end portion.

21. The watch band as defined in claim 20, wherein the securement of the keeper to the second end portion provides a bump on the top surface of the second end portion, wherein the bump defines the male portion of the retention assembly.

22. The watch band as defined in claim 21, wherein the first end portion has first and second raised portions on the top surface thereof, the first and second raised portions being separated from one another to define a gap therebetween, wherein the gap defines the female portion of the retention assembly.

23. The watch band as defined in claim 20, wherein the first end portion has first and second raised portions on the top surface thereof, the first and second raised portions being separated from one another to define a gap therebetween, wherein the gap defines the female portion of the retention assembly.

24. The watch band as defined in claim 18, wherein the first and second end portions are connected to one another, thereby defining that the free ends of the first and second end portions are opposite ends of the watch band.

25. The watch band as defined in claim 18, wherein the first end portion has an end opposite the free end thereof which is configured to be secured to a first bar of a watch casing, and wherein the second end portion has an end opposite the free end thereof which is configured to be secured to a second bar of the watch casing.

26. A method of securing a watch band comprising the steps of:

a) providing a watch band comprising a first end portion having top and bottom surfaces, the first end portion defining a free end thereof, the first end portion having a plurality of apertures provided therethrough, a second end portion having top and bottom surfaces, the second end portion defining a free end thereof, the second end portion having a buckle secured thereto at the free end thereof, the buckle having a prong, the second end portion having a keeper secured thereto distal from the free end thereof, and a retention assembly comprising first and second portions which are configured to interlock with one another, the first portion of the retention assembly being associated with the second end portion proximate the keeper, the second portion of the retention assembly being associated with the first end portion between the plurality of apertures and the free end of the first end portion;

b) inserting the free end of the first end portion into and through the buckle until a desired position is achieved;

c) inserting the prong of the buckle into and through one of the plurality of apertures provided through the first end portion;

d) inserting the free end of the first end portion into and through the keeper and thereby past the first portion of the retention assembly, thereby providing that an excess portion of the first end portion extends beyond the keeper, wherein the excess portion of the first end portion includes the second portion of the retention assembly;

e) folding a portion of the excess portion of the first end portion over on itself, wherein the portion of the excess portion of the first end portion includes the second portion of the retention assembly; and f) interlocking the first portion of the retention assembly with the second portion of the retention assembly.

27. The method as defined in claim 26, wherein the first portion of the retention assembly is a male portion which is associated with the second end portion, and wherein the second portion of the retention assembly is a female portion that is associated with the first end portion.

28. The method as defined in claim 27, wherein the male portion is provided by a portion of the top surface of the second end portion, and wherein the female portion is provided by a portion of the top surface of the first end portion.

29. The method as defined in claim 28, wherein the securement of the keeper to the second end portion provides a bump on the top surface of the second end portion, wherein the bump defines the male portion of the retention assembly.

30. The method as defined in claim 29, wherein the first end portion has first and second raised portions on the top surface thereof, the first and second raised portions being separated from one another to define a gap therebetween, wherein the gap defines the female portion of the retention assembly.

31. The method as defined in claim 28, wherein the first end portion has first and second raised portions on the top surface thereof, the first and second raised portions being separated from one another to define a gap therebetween, wherein the gap defines the female portion of the retention assembly.

* * * * *